US005610649A

United States Patent [19]

Kokubo

[11] Patent Number: 5,610,649

[45] Date of Patent: Mar. 11, 1997

[54] COLOR THERMAL PRINTING METHOD

[75] Inventor: Hideyuki Kokubo, Saitama, Japan

[73] Assignee: Fuji Photo Film Co., Ltd., Kanagawa, Japan

[21] Appl. No.: 233,745

[22] Filed: Apr. 26, 1994

[30] Foreign Application Priority Data

Apr. 26, 1993 [JP] Japan ..... 5-099886
Feb. 8, 1994 [JP] Japan ..... 6-014672

[51] Int. Cl.[6] ..... B41J 2/32
[52] U.S. Cl. ..... 347/175
[58] Field of Search ..... 347/172, 175, 347/174; 400/120.03

[56] References Cited

U.S. PATENT DOCUMENTS 4,734,704 3/1988 Mizutani et al. .

FOREIGN PATENT DOCUMENTS 61-94453 5/1986 Japan .
62-127255 6/1987 Japan .

*Primary Examiner*—Huan H. Tran

[57] ABSTRACT

A color thermal printing method capable of preventing a color registration shift and shading is unable with a color thermosensitive recording sheet having cyan, magenta, and yellow thermosensitive coloring layers, respectively formed on a base in this order. A thermal sensitivity becomes lower the nearer the thermosensitive coloring layer is to the base. The thermosensitive coloring layer having a lower sensitivity is printed at an earlier timing to make the centers of three color print areas coincident with each other. According to a preferred embodiment, a preliminary pressed running section is provided in front of each print area. In the preliminary pressed running section, a thermal head is preheated and pressed against a color thermosensitive recording sheet. In order to reduce a change in the friction coefficient between the preliminary pressed running section and the print area, the heat energy for the preheating is set to a bias heat energy having a level just under a coloring energy. This bias heat energy having a level just under a coloring energy changes with color so that the preliminary pressed running section is set differently for each color. During the preliminary pressed running operation, a pulse motor for driving a platen drum is driven by the same predetermined number of drive pulses for all three colors.

20 Claims, 12 Drawing Sheets

COLOR THERMAL PRINTING METHOD

BACKGROUND OF THE INVENTION

1. Field of the Invention

The present invention relates to a color thermal printing method, particularly suitable for a direct color thermal printing method.

2. Description of the Background Art

Color thermal printing methods include a thermal transfer printing method using a color ink ribbon or a color ink sheet and a direct color thermal printing method using a color thermosensitive recording sheet.

In the thermal transfer printing method, a color ink ribbon or color ink sheet is placed on a recording sheet (image reception sheet), and the back of the color ink ribbon or color ink sheet is heated to transfer color ink onto the recording sheet. The thermal transfer printing method includes two types, one type sublimating color ink and transferring it onto a recording sheet, the other type melting color ink and transferring it onto a recording sheet.

A color ink ribbon is used for a serial printer which performs three color line sequential printing, and has a yellow ink area, a magenta ink area, and a cyan ink area formed in a predetermined order over one line length. A color ink sheet is used for a line printer which performs three color frame sequential printing. Three color sheets of yellow, magenta, and cyan are used for printing a full-color image. In addition to three primary colors, there are a four color ink ribbon and four color ink sheets containing black color.

The sublimation transfer type is suitable for printing a full-color image because the density of an ink dot of one pixel can be changed with heat energy. The thermal wax transfer type is suitable for printing characters and lines because the density of an ink dot cannot be changed. When printing a half tone color image by a thermal wax transfer type printing method, an area gradation method is used. With this area gradation method, one pixel is divided into a plurality of subsidiary lines, and a subsidiary ink dot is selectively transferred onto each subsidiary line. One ink dot of one pixel is constituted by these subsidiary ink dots. Each ink dot changes its area in accordance with a gradation level. Of the plurality of subsidiary lines, the first subsidiary line faces a heating element first. In transferring a subsidiary dot onto this first subsidiary line, a wide drive pulse is used in order to raise the temperature of the heating element to an ink transfer temperature. In transferring subsidiary ink dots onto the second and following subsidiary lines, narrow drive pulses are used which are sufficient for maintaining the heating element at the ink transfer temperature.

With the direct color thermal printing method, a color thermosensitive recording sheet is directly heated to develop colors. The density of an ink dot of one pixel changes with heat energy. As described, for example, in U.S. Pat. No. 4,734,704 (corresponding to JP-A 61-213169), a color thermosensitive recording sheet has a magenta thermosensitive coloring layer, a cyan thermosensitive coloring layer, and a yellow thermosensitive coloring layer, respectively formed on a base in this order. In the color thermosensitive recording sheet, the lower the thermosensitive coloring layer, the lower the heat sensitivity. Each thermosensitive coloring layer is optically fixed by electromagnetic rays having a wavelength specific thereto. A coloring heat energy is required to record an ink dot on one pixel. This coloring heat energy is a sum of a heat energy of a level immediately before coloring (hereinafter called a bias heat energy which is changed with color) and a heat energy for coloring at a desired density (hereinafter called an image heat energy).

For example, in printing a full-color image on a color thermosensitive recording sheet, a thermal head is used which has a plurality of heating elements disposed in line in the main scan direction. For example, a color thermosensitive recording sheet is wound about a platen drum, and is moved in the subsidiary scan direction by rotating the platen drum. While the recording sheet is moved, a thermal head heats it and prints a yellow image on the yellow thermosensitive coloring layer. After this printing, the yellow thermosensitive coloring layer is optically fixed by applying light having a wavelength which decomposes only a diazonium salt compound of the yellow thermosensitive coloring layer. Next, a coloring energy higher than that of the yellow thermosensitive coloring layer is applied to the magenta thermosensitive coloring layer so as to print a magenta image on the magenta thermosensitive coloring layer. After this printing, the magenta thermosensitive coloring layer is optically fixed by applying light having a wavelength which decomposes only a diazonium salt compound of the magenta thermosensitive coloring layer. Lastly, a largest coloring heat energy is applied so as to print a cyan image on the cyan thermosensitive coloring layer.

With a conventional direct color thermal printing method, the three color thermosensitive coloring layers are sequentially caused to record while starting at the same print start position on the color thermosensitive recording sheet. As a result, the print length in the subsidiary direction changes with color, and the color registration shift amount becomes larger towards the trailing edge of the image frame of the recording sheet. This color registration shift causes a change in the tone of a color image and an unsharp image.

It is hypothesized that a change in the print length in the subsidiary direction results from an expansion/contraction of a color thermosensitive recording sheet generated by a printing heat. For example, if polyethylene terephthalate (PET) is used as the material of the base of a color thermosensitive recording sheet, the base is expanded temporarily by a printing heat, and recovers the original condition after printing. As shown in FIG. 16, the printed length AY of a yellow image printed with a smallest coloring heat energy is shortest because a contraction during printing is smallest. The printed length AC of a cyan image printed with a largest coloring heat energy is longest because a contraction during printing is largest. A difference between printed lengths is one to two lines or one to two pixels on an A6 size color thermosensitive recording sheet.

In both the cases of the thermal transfer printing method and direct color thermal printing method, a thermal head is cold before printing so that its temperature will not rise to a predetermined value just at printing time. As a result, the density at the print start area is low which generates a so-called shading, i.e., difference in density between positions on the recording sheet.

A rubber roller is used as a platen drum in a general thermal printer. Rotation force of a pulse motor is transmitted via a belt to the platen drum. Immediately after the start of rotation, the platen drum is deformed because of the elastic nature of rubber and cannot rotate without being in the deformed state. The belt has some play. Because of the deformation of the platen drum and the play of the belt, feeding of a recording sheet becomes unstable immediately after the start of rotation, or in some cases a recording sheet is not fed at all. With the thermal transfer printing method, if a recording sheet is stopped over several lines and a thermal head is driven, the heating elements heat an ink ribbon or ink sheet a plurality of times at an identical position. In such a case, the base of the ink ribbon or ink sheet may be dissolved and attached to the heating elements, resulting in a poor heat conduction property of the heating elements and in some cases in a disability of printing. With the direct color thermal printing method, if heat energies for a plurality of pixels are applied to the same area, the underlying thermosensitive coloring layer may develop color, resulting in mixed colors. In both the printing methods, a color registration shift is generated if feeding a recording sheet is unstable.

In order to solve the above problems, various methods have been proposed. For example, Japanese Patent Laid-open Publication No. 61-94453 has proposed a method of starting printing at a timing delayed from the start of rotation of a platen drum, without starting printing at the same time when the platen drum is rotated. More specifically, a short preliminary running area is formed upstream of the print area. In the preliminary running area, the platen drum is rotated while a thermal head is pressed against a recording sheet. Under this condition, the platen drum is deformed by a maximum friction force of the thermal head pressed against the recording sheet, and the mechanical play of the belt and the like is absorbed. It becomes possible therefore to feed a recording sheet stably in the print area.

A recording sheet is generally wound about a platen drum which is slightly swelled on the clamper side. This swell is gradually diminished as the platen drum rotates further. This swell results in unstable feeding of a recording sheet, and the state of a swell is not always constant. Because of these reasons, a color registration shift is generated in three color frame sequential printing. In view of this, another method has been proposed, for example, in Japanese Patent Laid-open Publication No. 62-127255 wherein a recording sheet is fed a short preliminary distance while being pressed against the platen drum by a thermal head.

However, as described above, even if a recording sheet is fed short preliminary running distance while being pressed by the thermal head, a color registration shift cannot be removed completely.

A friction coefficient between a recording sheet and a thermal head changes with a heat energy generated by the thermal head. As shown in FIG.15, as the temperature of a thermal head rises, a friction coefficient tends to be lowered. Therefore, the friction coefficient lowers instantly when the thermal head enters the print area so that feeding of a recording sheet changes and a pixel position is displaced. The direct color thermal printing method uses a different heat energy for each recording color. Therefore, a large change in the friction coefficient occurs between the preliminary running area and print area, and hence a large color registration shift occurs.

SUMMARY OF THE INVENTION

It is a principal object of the present invention to provide a color thermal printing method capable of preventing a color registration shift caused by a thermal expansion/contraction of a color recording sheet and deformation and play of a feeding mechanism of a color recording sheet.

It is another object of the present invention to provide a color thermal printing method capable of preventing shading.

It is a further object of the present invention to provide a method of effectively eliminating a color registration shift caused by a difference of the coloring heat energy between colors, in a direct color thermal printing method.

In order to achieve the above and other objects of the present invention, a color thermal printing method is provided in which the centers of the print areas of respective colors are made to coincide with each other in the subsidiary scan direction by changing the print start positions of respective colors in the subsidiary scan direction. According to the present invention, the color registration shift amount is distributed and halved on the leading and trailing edge sides of a color thermosensitive recording sheet so that the color registration amount on the trailing edge side is halved. In most color images taken by an electronic still camera or the like, the main subjects are positioned at the central areas of image frames. According to the present invention, there is no color registration shift at the central area of a frame, so that a color registration shift of the main subject can be eliminated.

According to a preferred embodiment of the present invention, a thermal head is preheated in a preliminary pressed running section at a heat energy having a level not transferring ink or not developing color. With this preheating, it is possible to set each heating element to a desired temperature at the start of printing, thereby eliminating shading. In the thermal transfer printing method, a heat energy generated by the preheating is the same for each color.

In the direct color thermal printing method, a color thermosensitive recording sheet uses a different bias heat energy for each color. In order to prevent the generation of shading or a large change in the friction coefficient, it is preferable to change a heat energy for each color during the preheating. If the heat energy is changed with color, the friction coefficient at the preliminary pressed running section changes with color. As a result, even if the same number of pulses is supplied to the pulse motor for driving the platen drum during the preliminary pressed running operation, the rotation amount of the platen drum becomes different for each color. In order to make color print areas coincident with each other, the preliminary pressed running section is changed with color. For example, since the cyan thermosensitive coloring layer has a highest coloring heat energy and the friction coefficient becomes smallest, the preliminary pressed running section is made longest.

The heat energy to be used for preheating may be the same as a bias heat energy having a level just under a coloring heat energy. At the initial stage of the preliminary pressed running section, the platen drum may not rotate in some cases. In such a case, a bias heat energy is applied to the same area a plurality of times, and color develops at this area. It is therefore preferable to preheat at a heat energy about one-half of the bias heat energy during the period while the platen drum is rotated by a first several lines. This preheating at a low heat energy may result in a heat energy insufficient for printing a cyan thermosensitive coloring layer. This insufficient heat energy is supplemented by increasing an image heat energy during the printing.

According to the present invention, a thermal head is preheated in the preliminary pressed running section so that shading is not generated. In a conventional printing method, the platen drum comes to a standstill at the start of printing so that there is no inertia, and the friction coefficient between the thermal head and recording sheet is large. As a result, the pulse motor for driving the platen drum may be overdriven and enter a malfunction state. According to the present invention, however, the friction coefficient is lowered by the preliminary pressed running operation, so that it is possible to prevent such a malfunction of the pulse motor. It is not necessary to prepare a particular print sequence such as an idle drive of the thermal head which has been necessary heretofore. Because the printing operation starts in a thermal equilibrium state, grey balance will not be deteriorated particularly in the case of a color thermosensitive recording sheet which has a different coloring temperature for each color.

For a color thermosensitive recording sheet, the length of the preliminary pressed running section and a heat energy for the preheating in the preliminary pressed running section are changed with each color, thereby eliminating a color registration shift. If the heat energy for the preheating is set to the bias heat energy, the friction coefficients during the preliminary pressed running operation and during the printing operation can be made equal, thereby reliably eliminating a color registration shift. According to the printing method of this invention, it is sufficient if a print sequence only is modified, and it is not necessary to raise the simple rigidity of a feed system of a color thermosensitive recording sheet to a degree reducing play and deformation of the system.

Since the heat energy for the preheating in the preliminary pressed running section is set to about one-half of the bias heat energy, there is no fear that the same area of a color thermosensitive recording sheet would be over heated and colored during the period while play and deformation of the feed system of the recording sheet are absorbed.

The heat energy for the preheating in a cyan image printing process is set as low as about the bias heat energy of the magenta thermosensitive coloring layer, thereby preventing the generation of yellow stains which are generated, by a high heat energy, from yellow and magenta coloring components still not colored but optically fixed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above and other objects and advantages of the present invention will become apparent from the detailed description of the preferred embodiments when read in conjunction with the accompanying drawings, which are given by way of illustration only and thus are not limitative of the present invention and in which.

DETAILED DESCRIPTION OF THE PREFERRED EMBODIMENTS

Figure 1:
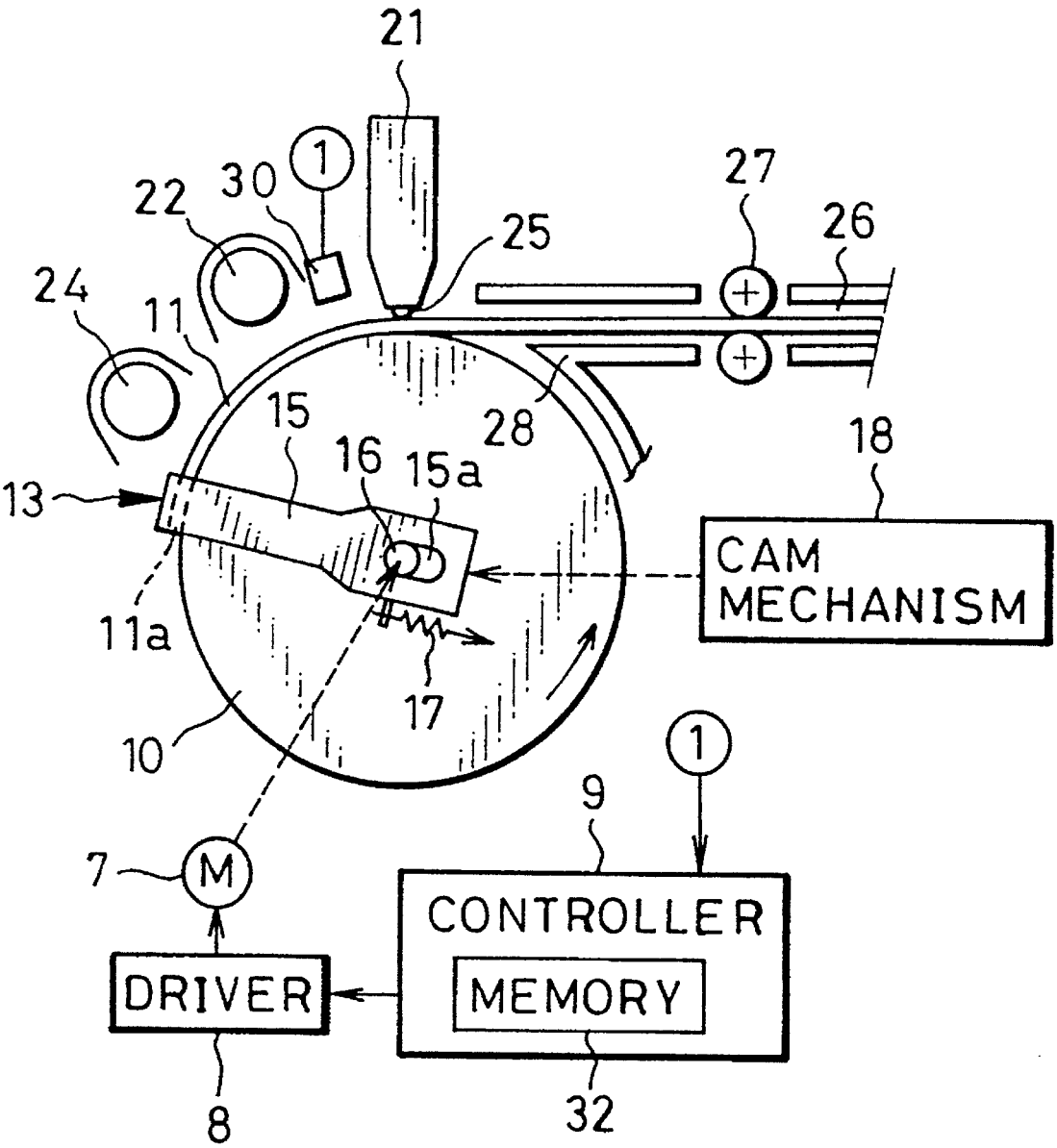
FIG. 1 is a schematic diagram showing a direct color thermal printer embodying the present invention.

Referring to FIG. 1, a platen drum 10 holds a color thermosensitive recording sheet 11 on the outer circumference thereof to feed it in the subsidiary scan direction. The platen drum 10 is made of a hard rubber roller, and rotated by a pulse motor 7 via a transmission mechanism such as a belt. The pulse motor 7 is controlled by a controller 9 via a driver 8.

The color thermosensitive recording sheet 11 is clamped by a clamper 13 at its leading edge portion 11*a* relative to the circumferential wall of the platen drum 10. The clamper 13 is of a channel shape riding over the platen drum 10. A side arm 15 of the clamper 13 is formed with an elongated hole 15*a* which is fitted around a shaft 16 of the platen drum 10. A spring 17 is coupled to the side arms 15 for biasing the clamper 13 toward the clamping position. A cam mechanism 18 moves the clamper 13 between the clamping position and a clamping release position. At the clamping position, the clamper 13 presses the leading edge portion of the color thermosensitive recording sheet 11 against the circumferential wall of the platen drum 10 by the force of the spring 17. At the clamping release position, the clamper 13 moves apart from the color thermosensitive recording sheet 11 against the force of the spring 17.

A thermal head 21, a yellow fixing lamp 22, a magenta fixing lamp 24 are sequentially disposed along the outer circumference of the platen drum 10. The thermal head 21 is provided with a heating element array 25, and presses and heats the color thermosensitive sheet 11 when printing. The pressure by the thermal head 21 improves heat conduction and concentrates heat on a necessary part. When not printing, the thermal head 21 is moved away from the platen drum 10 by a pressing mechanism (not shown).

Figure 5:
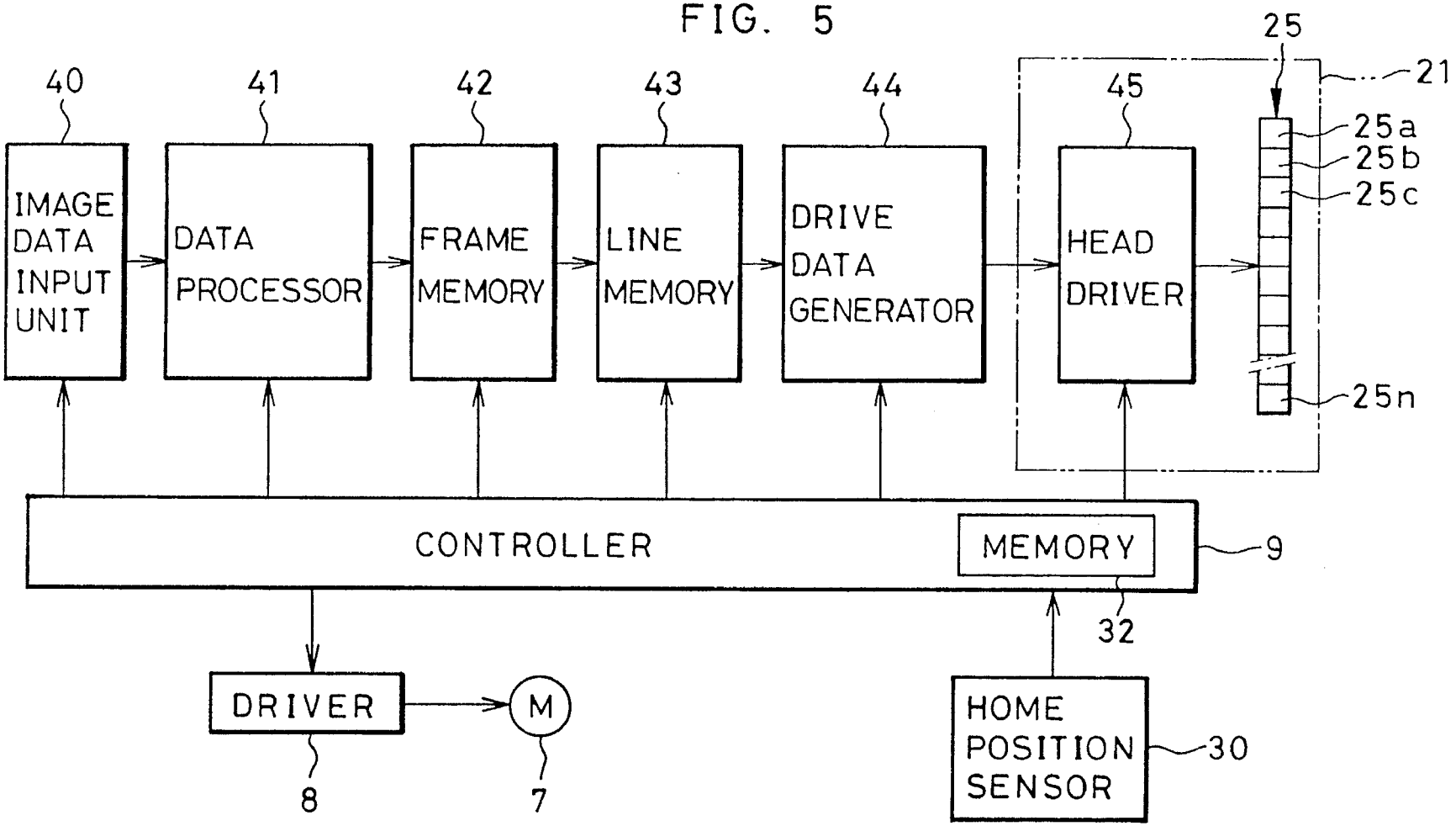
FIG. 5 is a circuit block diagram of a direct color thermal printer.

As shown in FIG. 5, the heating element array 25 has a number of heating elements 25*a*, 25*b*, . . . , 25*n* disposed in line in the main scan direction perpendicular to the subsidiary scan direction which is the direction of moving the color thermosensitive recording sheet 11. The yellow fixing lamp 22 is of a rod type extending in the axial direction of the platen drum 10, and emits ultraviolet rays having an emission peak of about 365 nm. The magenta fixing lamp 24 emits ultraviolet rays having an emission peak of about 420 nm.

A pair of feed rollers 27 are mounted on a sheet feed/discharge path 26 through which the color thermosensitive recording sheet 11 is fed or discharged. A separation claw 28 is formed at the sheet feed/discharge path 26 on the platen drum 10 side so as to guide the trailing edge portion of the color thermosensitive recording sheet 11 when the sheet 11 is discharged. In this embodiment, one path is used for both the sheet feed path and sheet discharge path. Two paths may be provided separately. If a sheet discharge path is separately provided, the platen drum 10 is rotated in the same direction as that of printing while pressing the recording sheet 11 by the thermal head 21 so as to discharge the recording sheet 11 passing under the clamper 13 at the clamping release state.

A home position sensor 30 is mounted near at the outer circumference of the platen drum 10. The home position sensor 30 detects the clamper 13 and judges that the print start position (the top of the print area) of the color thermosensitive recording sheet 11 faces the heating element array 25 of the thermal head 21. This print start position is used for the thermal recording of the yellow thermosensitive coloring layer, and the positions for the other colors are displaced from this print start position in accordance with an expansion/contraction amount of the color thermosensitive recording sheet 11 caused by heat. A signal detected by the home position sensor 30 is sent to the controller 9.

The controller 9 is constructed of a known microcomputer, and sequentially controls each circuit portion of the printer to print a color image by three color frame sequential printing. The controller 9 displaces the print start positions of magenta and cyan colors so as to suppress a color registration shift in the subsidiary scan direction caused by a thermal expansion/contraction of the color thermosensitive recording sheet 11. Specifically, the controller 9 reads print start position displacement amounts Lm/2 and Lc/2 and displaces the print start positions for the magenta and cyan colors from the print start position of the yellow color by Lm/2 and Lc/2 to print magenta and cyan images. This displacement amount is set to one-half of an expansion/contraction of the color thermosensitive recording sheet 11 so as to cancel a color registration shift at the center of the print area.

This displacement amount is determined in advance based upon the thermal characteristics and frame length of the color thermosensitive recording sheet 11. For example, if PET is used as the base of the color thermosensitive recording sheet 11, this sheet contracts when heated so that the displacement amounts Lm/2 and Lc/2 are negative. In an A6 size sheet, the contraction amount Lm corresponds to one line (about 140 μm), and the contraction amount Lc corresponds to two lines (about 280 μm).

If the displacement amount is negative, after the home position sensor 30 detects the home position, the controller 9 rotates the pulse motor 7 in the reverse direction by pulses corresponding in number to the displacement amounts Lm/2 and Lc/2, to thereby change the print start positions for the magenta and cyan images. For example, assuming that the number of drive pulses necessary for feeding one line is four, the print start position for the magenta image is moved back from the home position by two pulses, and that for the cyan image is moved back from the home position by four pulses.

If a yellow image starts printing after the platen drum 10 is rotated by a predetermined distance, for example, by one line by four drive pulses, after detecting the home position, the reverse rotation of the pulse motor is not necessary. In this case, a cyan image starts printing when the home position is detected, and a magenta image starts printing after two drive pulses have been supplied after detecting the home position.

Figure 2:
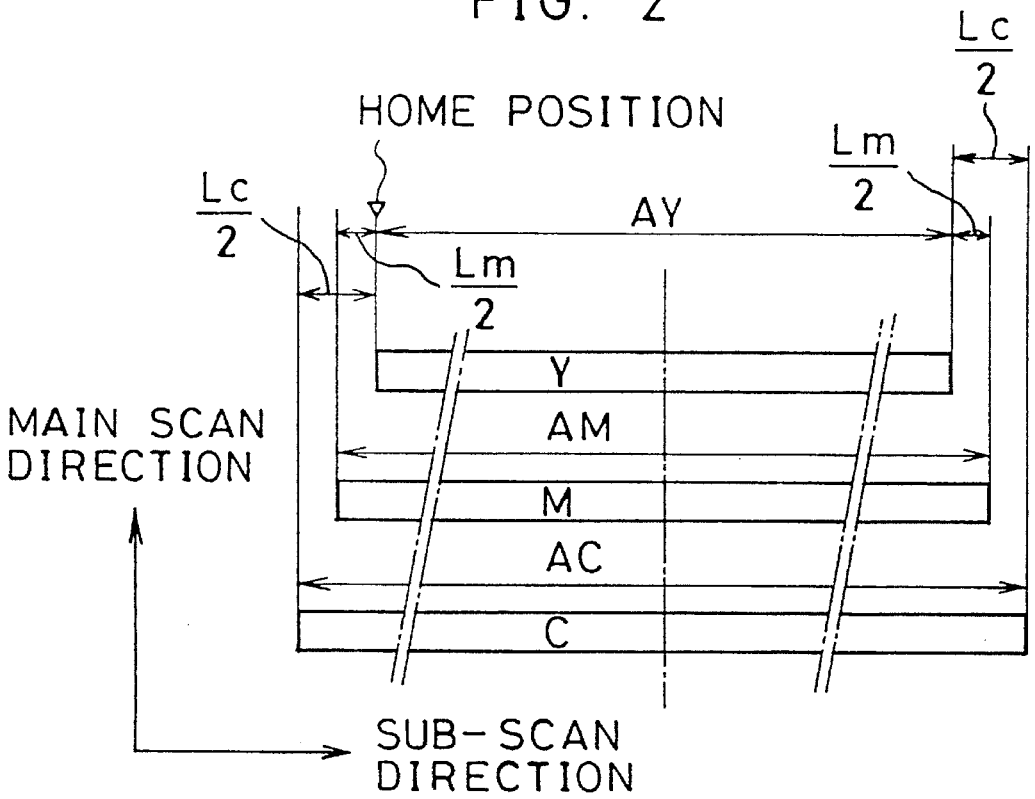
FIG. 2 is a schematic diagram explaining a difference of a print length between colors in the subsidiary scan direction when an image is printed by the direct color thermal printing method of this invention.
Figure 16:
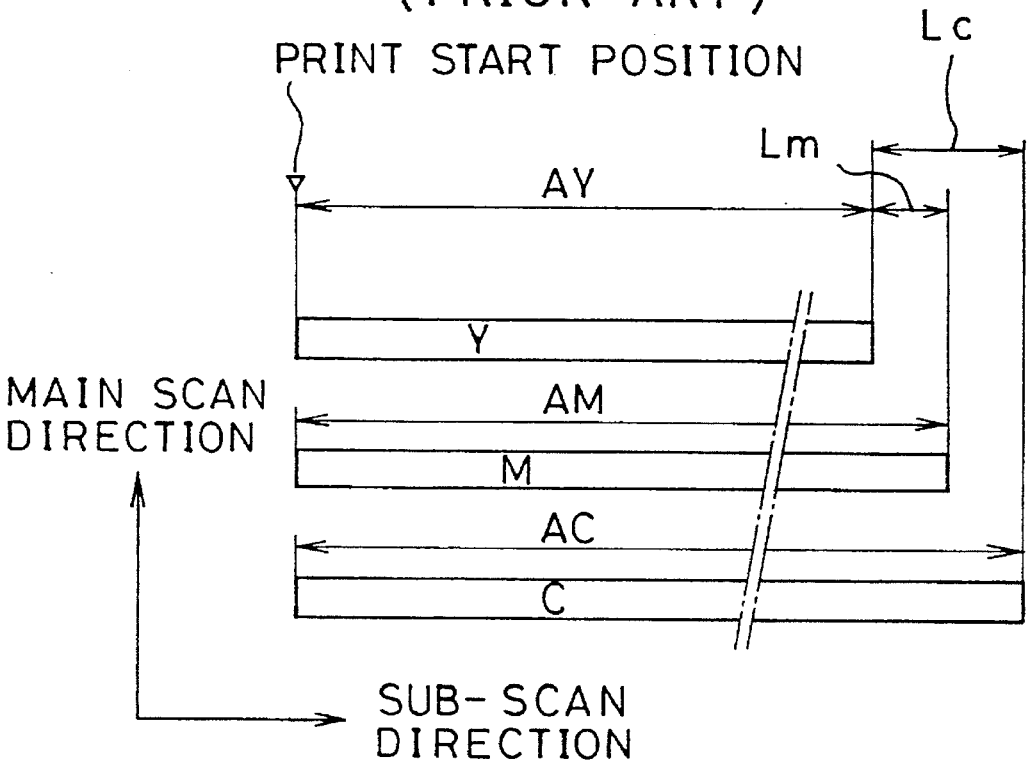
FIG. 16 (PRIOR ART)
FIG. 16 is a schematic diagram explaining a difference of a print length between colors in the subsidiary scan direction when an image is printed by a conventional direct color thermal printing method.

As illustrated in FIG. 2, the print lengths AY, AM, and AC of respective colors in the subsidiary scan direction are displaced so as to align the centers of these lengths at the center of the print image by changing the print start positions for respective colors. As a result, the color registration shift amounts are distributed between the leading and trailing edges of the color thermosensitive recording sheet 11. As compared to a conventional printing method described with reference to FIG. 16, the color registration shift amount is halved at the maximum and a color registration shift can be made not conspicuous. Most color images taken by an electronic still camera or the like have a main subject at the center position of the frame. Therefore, the printing method of this invention prevents the generation of a color registration shift of a main subject.

Figure 3:
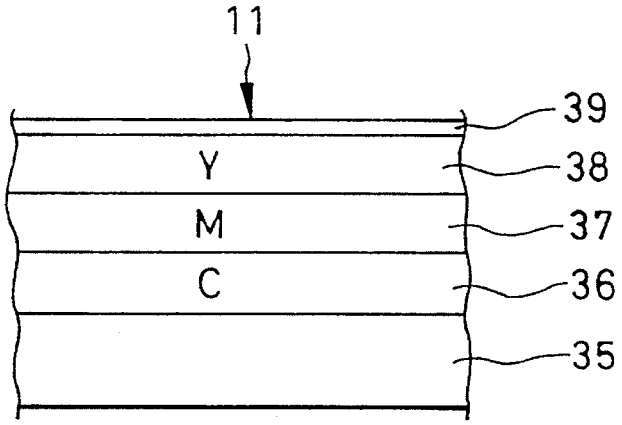
FIG. 3 is a schematic diagram showing an example of the layer structure of a color thermosensitive recording sheet.

FIG. 3 shows an example of the layer structure of the color thermosensitive recording sheet 11. On a base 35, a cyan thermosensitive coloring layer 36, a magenta thermosensitive coloring layer 37, a yellow thermosensitive coloring layer 38, and a protective layer 39 are formed in this order from the bottom. Each thermosensitive coloring layer 36–38 is layered in the order of thermal recording from the top. If thermal printing is performed in the order of magenta, yellow, and cyan, the yellow and magenta thermosensitive coloring layers are interchanged in layer position. A four layer structure may be used by adding a black thermosensitive coloring layer.

Figure 4:
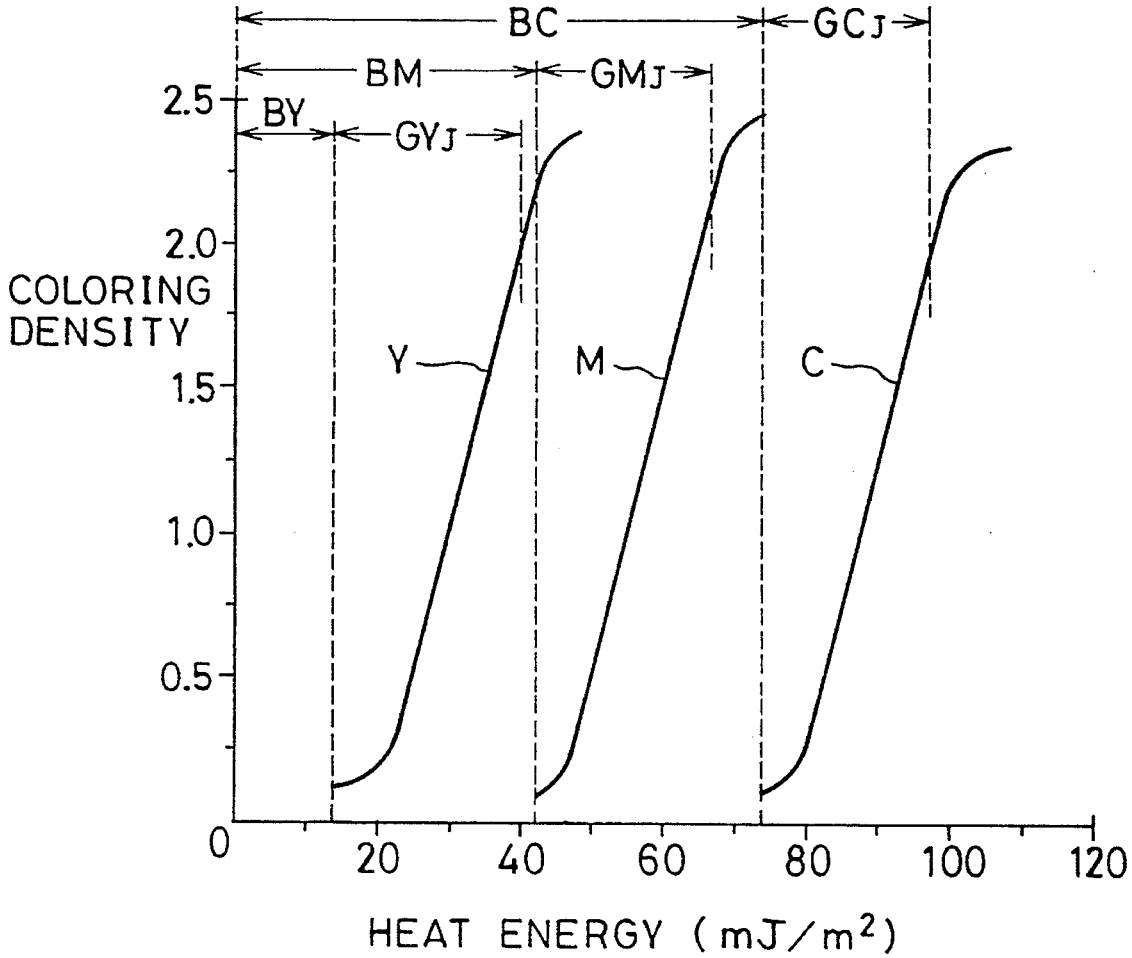
FIG. 4 is a graph showing the coloring characteristics of a color thermosensitive recording sheet.

As shown in FIG. 4, the deeper the thermosensitive coloring layer is positioned, the higher the coloring heat energy. Accordingly, the three color thermosensitive coloring layers 36 to 38 can be selectively caused to record by changing the coloring heat energy. The cyan thermosensitive coloring layer 36 has the lowest thermal recording sensitivity, requiring a large heat energy. The yellow thermosensitive coloring layer 38 is positioned near the obverse of the recording sheet 11 so that it requires a smallest heat energy. An intermediate layer (not shown) for providing a large coloring heat energy difference is formed between adjacent thermosensitive coloring layers.

In recording of the yellow thermosensitive coloring layer 38, each heating element applies a coloring heat energy to the color thermosensitive recording sheet 11. This coloring heat energy is a sum of a constant bias heat energy BY and an image heat energy GYj determined by a gradation level "J" of each pixel. The bias heat energy BY has such a level that the yellow thermosensitive coloring layer 8 is about to be colored. The heat energies for magenta M and cyan C are similar that yellow Y. In FIG. 4, these energies are discriminated by adding color characters M, C, and Y.

FIG. 5 is a circuit block diagram of the direct color thermal printer shown in FIG. 1. A color scanner, a color TV camera, or the like is connected to an image data input unit 40 to send three color image data of red, green, and blue to a data processor 41. This data processor 41 preforms a color correction and gradation correction of each color image data. The processed color image data is sent to a frame memory 42 and written therein in a color separated state. In printing color images, color image data is read from the frame memory 42 one line after another and written in a line memory 43.

One line image data read from the line memory 43 is sent to a drive data generator 44 and converted into drive data for each pixel. This drive data is constituted by bias drive data for generating a bias heat energy having a level just under a coloring level, and image drive data for generating a gradation heat energy. The one line drive data is sent to a head driver 45, converted into one wide bias pulse and narrow image pulses corresponding in number to the gradation level of each pixel, and supplied to each heating element 25*a*–25*n* of the heating element array 25. In this manner, each heating element is driven so as to provide a density corresponding to image data of each pixel. After one line of image data has been printed, the platen drum 10 is rotated by a predetermined number of steps to feed the color thermosensitive recording sheet 11 by one line. Similarly, image data is printed one line after another.

The operation of the printer will be briefly described. Each color image data input from the image data input unit 40 is processed by the image processor 41, and written in the frame memory 42 in a color separated state. The color thermosensitive recording sheet 11 is transported toward the thermal head 21 upon rotation of the platen drum 10 via the feed roller pair 27. The clamper 13 has been set to the clamping release state by the cam mechanism 18 so that the leading edge of the color thermosensitive recording sheet 11 passes under the clamper 13. After the leading edges passes under the clamper 13, the clamper 13 is set to the clamping state to clamp the leading edge portion of the color thermosensitive recording sheet 11. Immediately thereafter, the platen drum 10 is rotated.

While the platen drum 10 rotates, the home position sensor 30 detects the clamper 13. At this time, the leading edge of the yellow record area of the color thermosensitive recording sheet 11 faces the thermal head 21. From this time, printing of a yellow image starts. In printing the yellow image, the controller 9 sequentially reads yellow image data from the frame memory 42 one line after another and temporarily stores it in the line memory 43. Next, one line of image data is sequentially read in the pixel order from the line memory 43 and sent to the drive data generator 44. The drive data generator 44 converts the pixel image data into drive data which is sent to the head driver 45. The head driver 45 converts the drive data into drive pulses to drive the heating elements 25*a* to 25*n* responsively, to apply bias heat energies and image heat energies corresponding to the image data to the color thermosensitive recording sheet 11, and to develop color of each pixel to a desired density.

After the yellow image of the first line has been printed, the platen drum 10 is rotated by the pulse motor 7 by a distance corresponding to one pixel, and at the same time the yellow image data of the second line is read from the frame memory 42. In the similar manner as above, the yellow images of the second and following lines are printed one line after another on the color thermosensitive recording sheet 11. When the printed yellow image reaches the yellow fixing lamp 22, the yellow thermosensitive coloring layer 38 is optically fixed.

After the yellow image has been printed and the platen drum 10 has made one rotation, the platen drum 10 stops rotating when the home position sensor 30 detects the clamper 13. Thereafter, the platen drum 10 is rotated in the reverse direction by the print start position displacement amount Lm/2 read from a memory 32, to position the color thermosensitive recording sheet 11 so that the front edge of the magenta image print area faces the heating element array 25. Thereafter, the magenta image of each line is printed and the magenta thermosensitive coloring layer 37 is optically fixed by the magenta fixing lamp 24.

After the magenta image has been printed, the platen drum 10 stops rotating when the home position sensor 30 detects the clamper 13. The platen drum 10 is then rotated in the reverse direction by the print start position displacement amount Lc/2 read from the memory 32 to position the top of the cyan image print area at the heating element array 25. Thereafter, the cyan image of each line is printed. Optical fixation is omitted because the cyan thermosensitive coloring layer 36 will not develop color under a normal maintenance condition.

As shown in FIG. 2, the centers of the print lengths AY, AM, and AC of respective colors can be made coincident with each other by changing the print start positions of respective colors. It is possible therefore to distribute color registration shift amounts divided by ½ on the record start side and record end side. After each thermosensitive coloring layer has recorded, the platen drum 10 and feed roller pair 27 rotate in the reverse direction. With this reverse rotation of the platen drum 10, the trailing edge of the color thermosensitive recording sheet 11 is guided by the separation claw 28 to the sheet feed/discharge path 26 and nipped by the feed roller pair 27. Thereafter, the clamper 13 is set to the clamping release position by the cam mechanism 18 and the platen drum 10 stops. After the clamping release, the printed color thermosensitive recording sheet 11 is ejected out onto a tray (not shown) via the sheet feed/discharge path 26 by the rotation of the feed roller pair 27.

In the above embodiment, the recording sheet is intermittently fed. The recording sheet may be fed continuously. Although the direct color thermal printing method has been described, the present invention is applicable to a thermal transfer printing method if a color registration shift is generated by thermal expansion/contraction.

Figure 6:
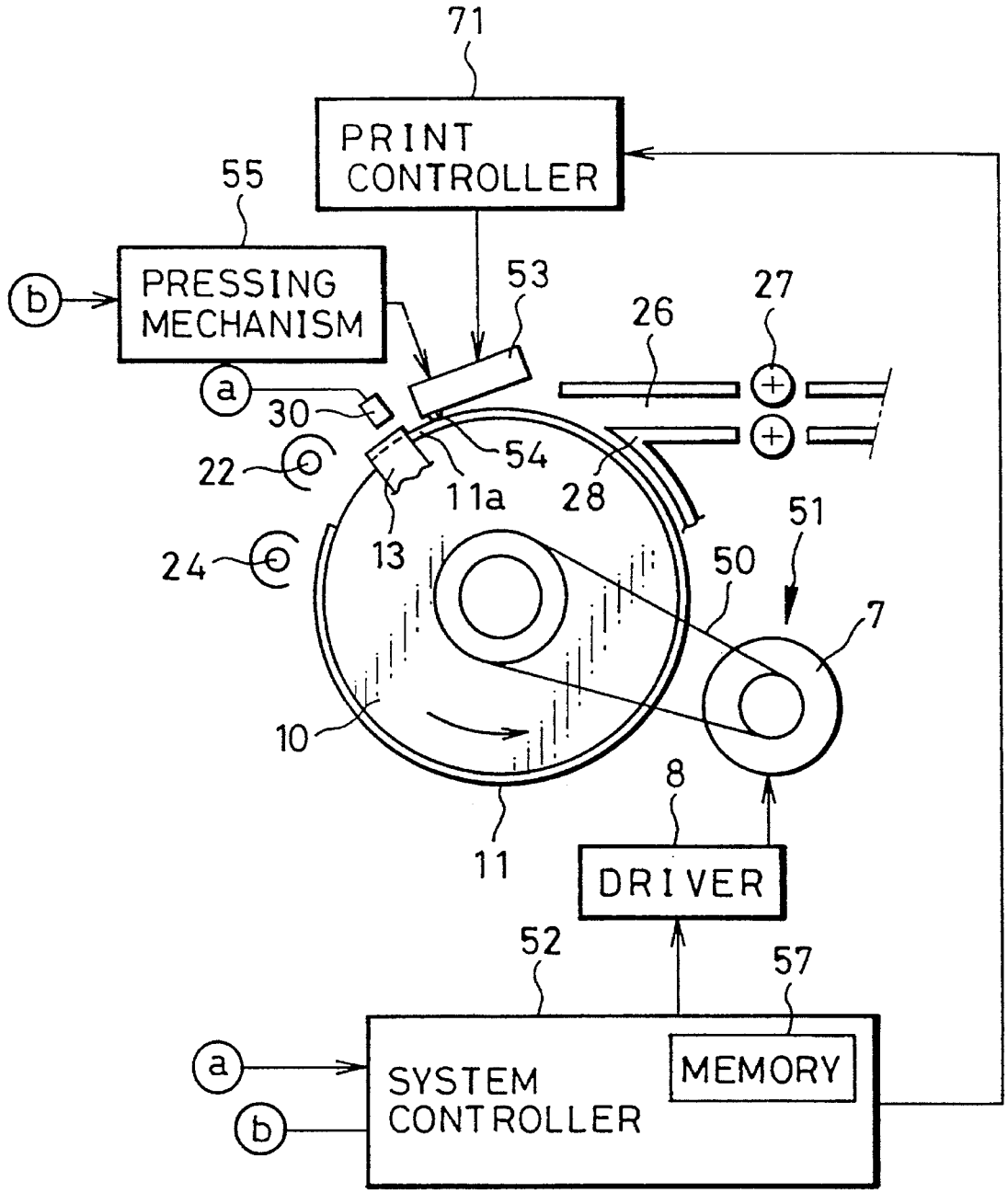
FIG. 6 is a schematic diagram showing a direct color thermal printer according to another embodiment.

Next, a method of improving a conventional preliminary pressed running particularly suitable for a direct color thermal printing method will be described. FIG. 6 shows a direct color thermal printer used with this method. Like elements to those shown in FIG. 1 are represented by identical reference numerals. A feed system 51 for a color thermosensitive recording sheet 11 is constituted by a platen drum 10, a pulse motor 7, and a belt 50. A system controller 52 generates motor drive pulses. The platen drum 10 is rotated by one line (one pixel) by applying four motor drive pulses to the pulse motor 7. The system controller 52 performs a preliminary pressed running control to reduce the influence of feed fluctuation of the color thermosensitive recording sheet 11 and suppress a color registration shift in the subsidiary scan direction immediately after the start of rotation of the platen drum 10.

A thermal head 53 has a heating element array 54 which is pressed against the platen drum 10 by a pressing mechanism 55. This pressing mechanism 55 is constituted by, for example, a motor and a cam mechanism. The pressing mechanism may be constituted by a spring energizing the thermal head 53 toward the platen drum 10 and a solenoid for retracting the thermal head 53 against the force of the spring.

Figure 7:
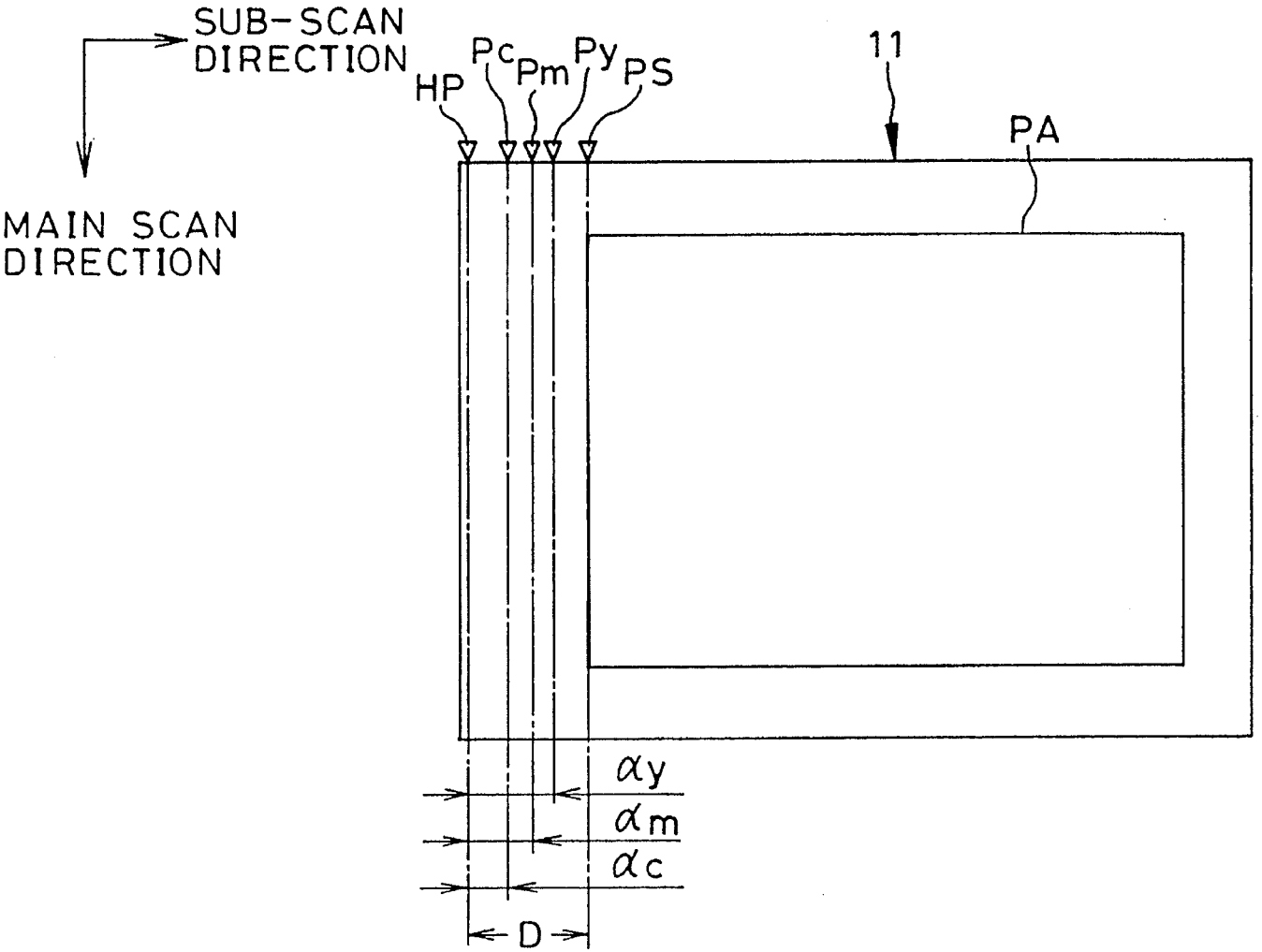
FIG. 7 is a schematic diagram showing the relationship between press start positions and print areas for respective colors of a color thermosensitive recording sheet.

As shown in FIG. 7, the preliminary pressed running control is performed for preventing a feed fluctuation of the color thermosensitive recording sheet 11 from being generated when each heating element 54 of the thermal head 53 positions at the end (print start position) PS of a print area PA of the recording sheet 11, and for providing an optimum printing state of heat balance between the thermal head 53 and the color thermosensitive recording sheet 11, platen drum 10, and the like.

Figure 15:
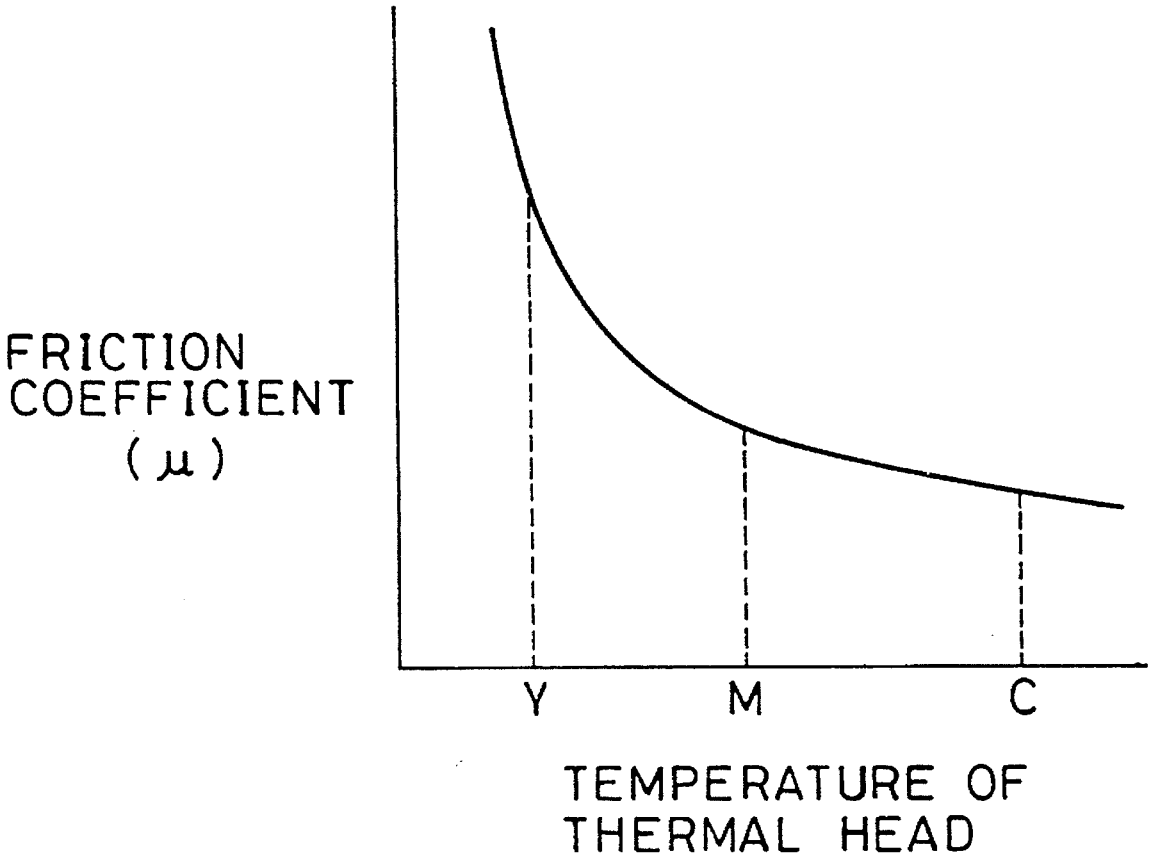
FIG. 15 is a graph showing the relationship between thermal head temperatures and friction coefficients.

In this embodiment, printing starts after a preliminary pressed running while preheating the recording sheet at a heat energy having a level under a coloring level. In order to prevent a change in the friction coefficient caused by heat during the preliminary pressed running and during the actual printing, it is preferable to use a bias heat energy as the preheating energy. As anticipated from the graph of FIG. 15, a friction coefficient changes with each bias heat energy BY, BM, BC, so that the feed amount of the color thermosensitive recording sheet 11 changes even if the same number of motor drive pulses is used. For example, the bias heat energy BY is smallest and the friction coefficient becomes large, to thus make the color thermosensitive recording sheet 11 difficult to move. Therefore, the preliminary pressed running section for the yellow preheating is made shortest, and that for the cyan preheating is made longest. With this setting, the heating element array 54 takes the same position on the color thermosensitive recording sheet 11 at the end of the preliminary pressed running section for each color.

A memory 57 in system controller 52 is written with the preliminary pressed running start position data Pαy, Pαm, and Pαc for the preliminary pressed running control of the thermal head 53. These data Pαy, Pαm, and Pαc represent the numbers of drive pulses of the pulse motor 7 corresponding to the distances αy, αm, and αc from the home position HP to the preliminary pressed running start positions Py, Pm, and Pc. The distances αy, αm, and αc are specific to each color and are set to prevent a color registration shift from being generated by an unstable feed of the color thermosensitive recording sheet 11 immediately after driving the platen drum 10. The feed fluctuation results from an inertia and play of the feed system, a deformation of rubber of the platen drum 10, a change in the friction coefficient between the thermal head 53 and the color thermosensitive recording sheet 11, and the like. The distances αy, αm, and αc are predetermined from experiments while considering the whole of the above factors causing the feed fluctuation. In printing a yellow image, the system controller 52 counts the number of motor drive pulses, starting from when the home position signal is detected. When the count becomes Pαy, the thermal head 53 is at the preliminary pressed running start position Py. The system controller 52 actuates the pressing mechanism 55 to press the heating element array 54 against the color thermosensitive recording sheet 11. After this pressing, the thermal head 53 applies the same heat energy as the yellow bias heat energy BY to the color thermosensitive recording sheet 11. The preliminary pressed running operation is executed over a predetermined number of lines during the preheating. More precisely, during the preliminary pressed running operation, a predetermined number of motor drive pulses are supplied to the pulse motor 7.

After this preliminary pressed running operation, the heating element array 54 enters the print area PA to print the yellow image of each line. In printing the yellow image of each line, each heating element applies the bias heat energy BY and image heat energy GYj to the color thermosensitive recording sheet 11 to create an ink dot having a density corresponding to the gradation level "J". Instead of the preliminary pressed running start position data Pαy, Pαm, and Pαc, alternative data of "DP-Pαy", "DP-Pαm", and "DP-Pαc" referenced to the print start position PS may be stored in the memory 32, wherein DP represents the number of drive pulses of the pulse motor 7 corresponding to the distance D from the home position HP to the print start position PS.

Also in the magenta printing operation, the number of motor drive pulses is counted from when the home position HP is detected. When the count becomes Pαm, it means that the heating element array 54 is at the preliminary pressed running start position Pm. Immediately thereafter, the pressing mechanism 55 is actuated as in FIG. 7 to press the thermal head 53 against the color thermosensitive recording sheet 11. After pressing the thermal head 53, the heating element array 54 is preheated to the magenta bias heat energy BM. After this preliminary pressed running operation with the preheating, the heating element array 54 faces the first line of the print area PA. Similarly, in printing the cyan image, the preliminary pressed running operation with the preheating starts from the preliminary pressed running start position Pc. The number of lines during the preliminary pressed running operation, i.e., the number of motor drive pulses, is the same for each color. Generally, the preliminary pressed running operation continues for the period corresponding to the longest preliminary pressed running start position shift amount of "DP-Pαc".

Figure 8:
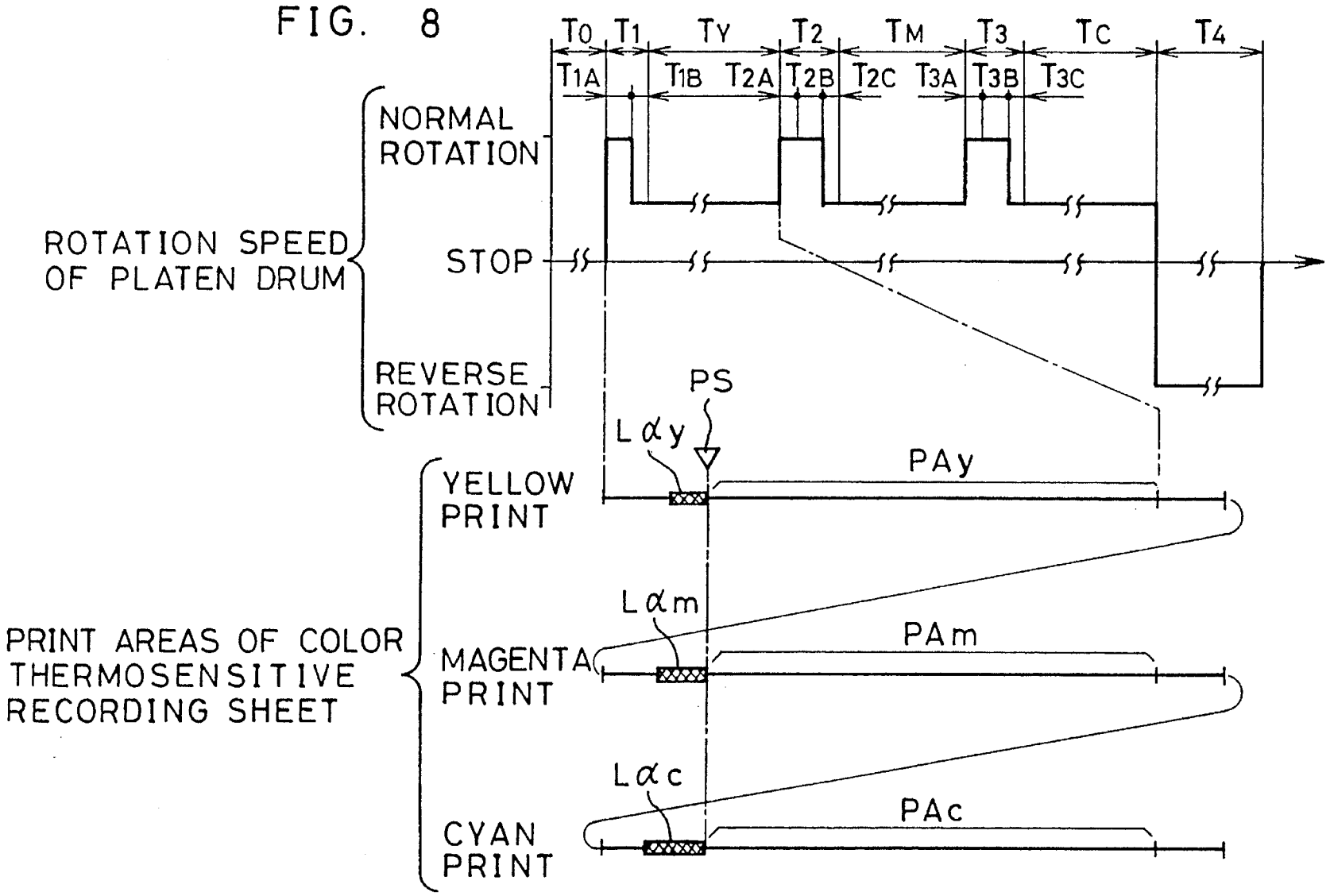
FIG. 8 is a diagram showing the relationship between platen drum rotation speeds and print areas for respective colors.

FIG. 8 shows the relationship between the rotation states of the platen drum 10 and the feed amounts of the color thermosensitive recording sheet 11. T0 represents a time period from when a print start button is depressed to when the color thermosensitive recording sheet 11 reaches the clamping position (home position HP). During this time period T0, the platen drum 10 maintains still. T1 represents a time period from when the clamper 13 fixes the leading end portion 11*a* of the color thermosensitive recording sheet 11 to the circumferential wall of the platen drum 10 to when the print start position PS of the print area PA of the color thermosensitive recording sheet 11 reaches the heating element array 54. This time period T1 has a time period T1A during which the platen drum 10 is rotated at high speed from the home position HP to the preliminary pressed running start position Py, and a preliminary pressed running time period T1B during which the platen drum 10 is rotated at print speed from the preliminary pressed running start position Py to the print start position PS.

TY represents a time period from the print start of the first line to the completion of the yellow optical fixation. T2 represents a time period during which the print start position PS of the print area PA of the color thermosensitive recording sheet 11 is rotated to the heating element array 54 after the yellow optical fixation. This time period T2 has a time period T2A during which the color thermosensitive recording sheet 11 is moved to the home position HP by rotating the platen drum 10 at high speed immediately after the yellow optical fixation, a time period T2B during which the color thermosensitive recording sheet 11 is moved at high speed from the home position HP to the preliminary pressed running start position Pm, and a preliminary pressed running time period T2C during which the platen drum 10 is rotated at print speed from the preliminary pressed running start position Pm to the print start position PS.

TM represents a time period from the magenta image print start to the completion of the magenta optical fixation. T3 represents a time period during which the print start position PS of the print area PA of the color thermosensitive recording sheet 11 is rotated to the heating element array 54 after the magenta optical fixation. This time period T3 includes a time period T3A of movement to the home position HP by rotating the platen drum 10 at high speed after the end of the magenta optical fixation, a time period T3B of movement at high speed from the home position HP to the preliminary pressed running start position Pc, and a preliminary pressed running time period T3C of rotation at print speed from the preliminary pressed running start position Pc to the print start position PS. Similarly, a time period Tc represents a cyan image print time, and a time period T4 represents a reverse rotation time for sheet discharge.

Preheating with a bias heat energy of each color is performed at each preliminary pressed running time T1B, T2C, T3C (T1B=T2C=T3C). The preliminary pressed running with preheating absorbs the play and the like of the feed system 51, and is illustrated in FIG. 8 by cross hatched preliminary pressed running sections Lαy, Lαm, and Lαc (Lαy<Lαm<Lαc). In this manner, the print areas PAy, PAm, and PAc of respective colors coincide with each other. Because of the preheating during the preliminary pressed running, the heat balance between the thermal head and recording sheet is ensured and the friction coefficients therebetween for respective colors become generally stable, thereby suppressing the feed fluctuation at the start of printing.

Figure 9A:
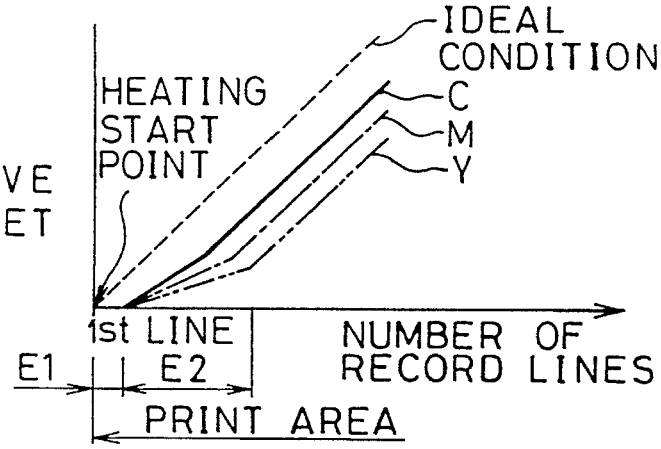
FIGS. 9A to 9D are diagrams showing the relationship between the numbers of lines and feed amounts of a color thermosensitive recording sheet.
Figure 9B:
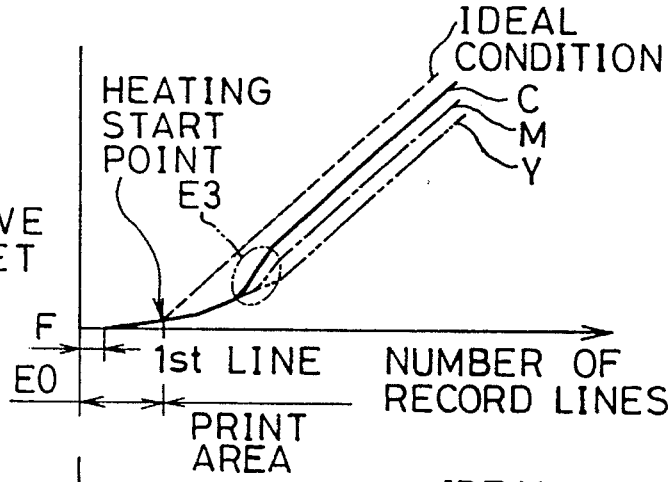
Figure 9C:
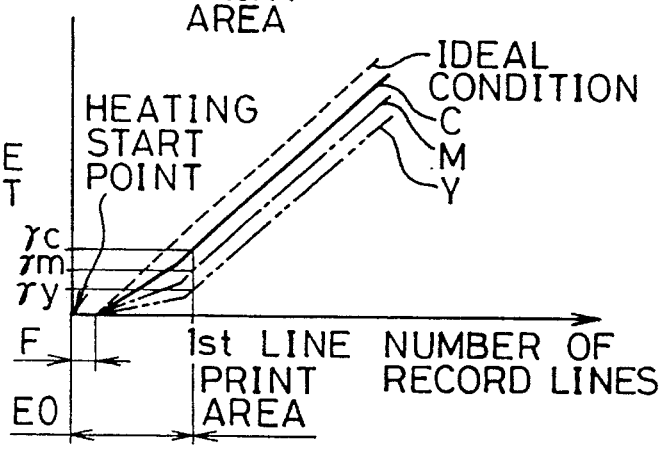
Figure 9D:
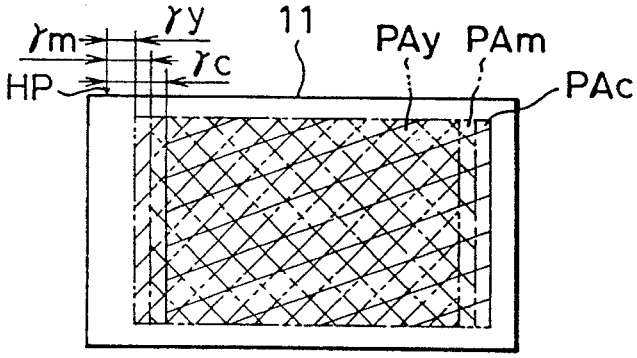

FIGS. 9A to 9D are diagrams explaining the print states of a color thermosensitive recording sheet. FIG. 9A shows a print state without the preliminary pressed running. FIG. 9B shows a print state with a conventional preliminary pressed running without preheating. FIG. 9C shows a print state with the preliminary pressed running with bias heating, starting at the same preliminary pressed running start position for each color. FIG. 9D shows the printed images under the print state of FIG. 9C in which the position displacements of the print areas PAy, PAm, and PAc are exaggerated. In FIG. 9D, solid lines indicate a cyan print image, one-dot chain lines indicate a magenta print image, and two-dot chain lines indicate a yellow print image. Ideal print states assuming that there is no deformation and play of the feed system 51 are indicated by broken lines.

As shown in FIG. 9A, if the preliminary pressed running is not performed, the color thermosensitive recording sheet 11 is not fed during a first several lines in a section E1 because of deformation and play of the feed system 51. In addition, during several lines to ten and several lines in a section E2 during which deformation and play are saturated, the feed amount per line lowers. Still in addition, since the preheating energy increases in the order of yellow, magenta, and cyan and the friction coefficient between the color thermal recording sheet and the thermal head decreases in this order, the actual feed amount of the color thermal recording sheet 11 relative to the same number of motor drive pulses increases in this order during the sections E1 and E2 during which deformation and play are saturated. After the deformation and play of the feed system 51 saturate, the feed amount of one line becomes generally constant irrespective of different bias heating energies so long as the preheating is stable.

Accordingly, the total feed amount of the color thermosensitive recording sheet 11 of each color becomes smaller than the ideal feed amount, resulting in a different print length of the print area of each color. The color thermosensitive recording sheet 11 is not fed during several lines (section E1) immediately after the start of printing, so that pixels are printed in a superposed manner. During the following ten and several lines (section E2), the actual feed amount is smaller than the designed feed amount, so that the space between lines is narrowed although this state is not so much serious as the section E1. Although the feed amount change is stabilized thereafter, the color registration shift appears over the whole print area because of the different feed amounts immediately after the start of printing.

In the case of the preliminary pressed running without preheating as shown in FIG. 9B, the friction coefficient is high and the deformation amount F (including play) of the feed system 51 is large, respectively during the section E0. It takes therefore some time to saturate the deformation and play. After the start of printing, the friction force generated by heat of the thermal head becomes small so that the deformation amount F of the feed system 51 changes to be balanced with the friction force. The space between several lines immediately after the start of printing becomes irregular, thereby aligning three color pixels at displaced positions.

In the case of the preliminary pressed running with preheating using the same heat energy as the bias heat energy as shown in FIG. 9C, the deformation amount F of the sheet feed system 17 is saturated during the preliminary pressed running so that the space between lines in the print area of each color becomes constant. Because the friction coefficient does not change greatly between the preliminary pressed running and the printing, the feed fluctuation at the print area immediately after the start of printing is not generated. The print lengths of respective colors in the print area become equal to each other.

However, the actual feed amounts γy, γm, γc of the color thermosensitive recording sheet 11 of respective colors are different. As shown in FIG. 9D, the dot record positions of three colors are displaced by γy, γm, and γc, resulting in a color registration shift between three colors. Therefore, as shown in FIG. 7, the preliminary pressed running start positions of the present invention are changed to be Py, Pm, and Pc to make three color pixels be coincident with each other in the print area PA. In this manner, three color frame sequential printing can be performed without any color registration shift.

Figure 10:
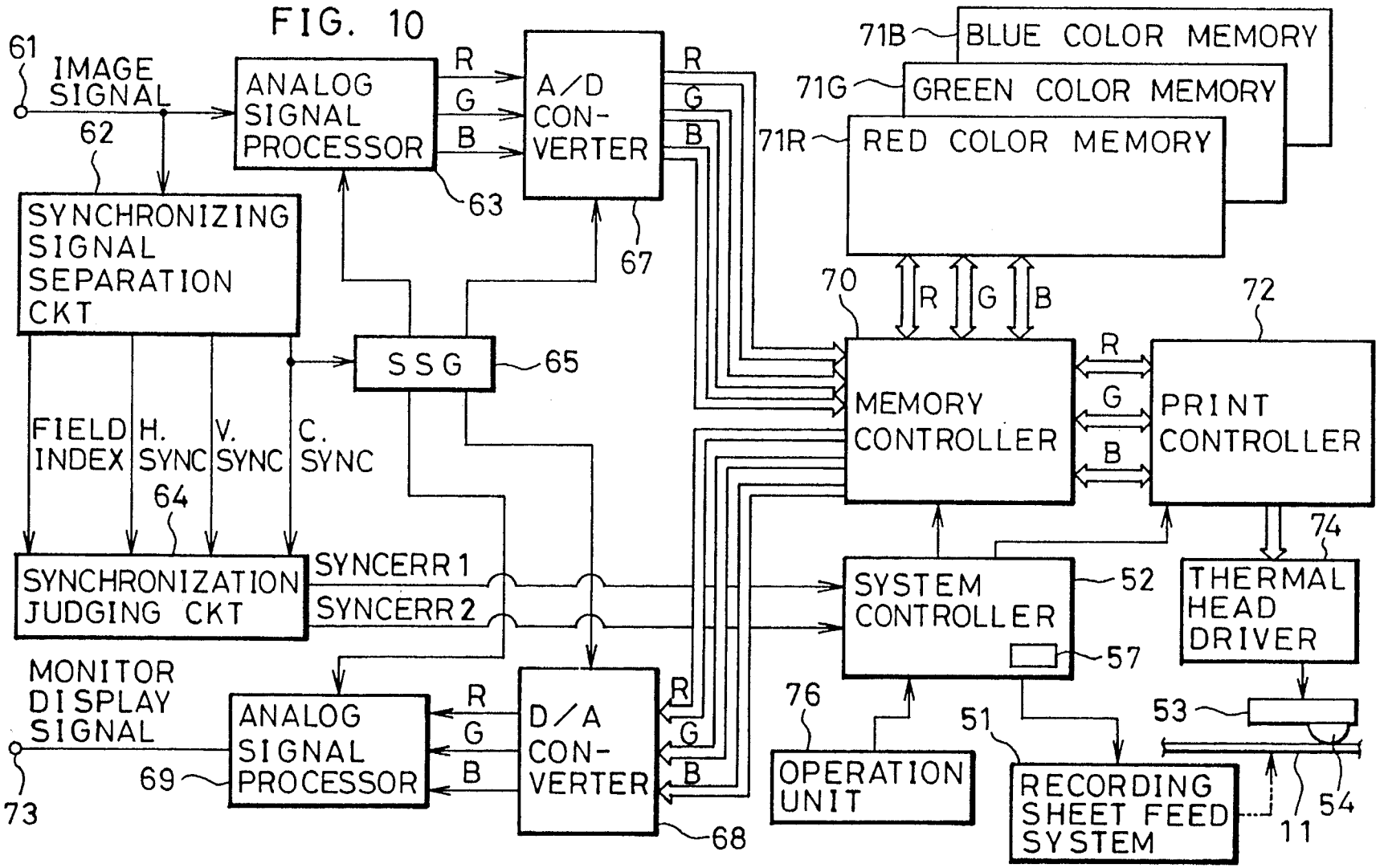
FIG. 10 is a circuit block diagram of the direct color thermal printer shown in FIG. 6.

FIG. 10 is a detailed circuit block diagram of a direct color thermal printer. A video camera, a VTR, a still video player, a TV game machine, or the like is connected to an input terminal 61. A halftone image signal is inputted from the input terminal 61 to a synchronizing signal separation circuit 62 and an analog signal processor 63. The synchronizing signal separation circuit 62 separates a composite synchronizing signal (C.SYNC) from the input video signal, and separates a vertical synchronizing signal (V.SYNC) and a horizontal synchronizing signal (H.SYNC) from the composite synchronizing signal. The synchronizing signal separation circuit 62 has an internal horizontal synchronizing signal generator and outputs a horizontal synchronizing signal if it cannot be separated from the composite synchronizing signal. The synchronizing signal separation circuit 62 sends the composite, vertical, and horizontal synchronizing signals of an H or L level to a synchronization judging circuit 64 and the composite synchronizing signal to an SSG (synchronizing signal generator) 65.

The synchronizing signal separation circuit 62 generates a field index signal in accordance with the phase relationship between the vertical and horizontal synchronizing signals. If an NTSC standard television signal is applied to the input terminal 61, the phase relationship between the vertical and horizontal synchronizing signals changes between odd and even fields. The field index signal whose level is inverted every field is generated by checking the phase relationship. If a video signal having only ones of even and odd fields is applied to the input terminal 61, the phase relationship between the vertical and horizontal synchronizing signals will not change and the field index signal of the same level is generated. The field index signal is sent to the synchronization judging circuit 64.

At the timings of the composite synchronizing signal sent from the synchronizing signal separation circuit 62, SSG 65 controls an analog signal processor 63, an A/D converter 67, a D/A converter 68, and another analog processor 69. The analog signal processor 63 separates the inputted image signal into a red signal, a green signal, and a blue signal, and outputs these color signals whose levels have been adjusted. Each color signal is sampled at each pixel by the A/D converter 67, and converted into a digital signal. The obtained red, green, and blue image data are sent to a memory controller 70.

A red frame memory 71R, a green frame memory 71G, and a blue frame memory 71B are memories for storing image data of "odd" and "even" fields by disposing scan lines alternately. The image data read/write is controlled by the memory controller 70.

A system controller 52 has an operation unit 76 connected thereto. One of "through", "print", and "freeze" is selected by manipulating the operation unit 76. A field switch for selecting either "odd field" or "even field" is mounted on the operation unit 76. Also mounted on the operation unit 76 is a mode switch for selecting either "frame mode" or "field mode". The system controller 52 controls the memory controller 70 for the image data read/write from/to the frame memories 71R, 71G, and 71B. The system controller 52 controls a recording sheet feed system 51 to feed a color thermosensitive recording sheet 11 and perform a preliminary pressed running operation with bias heating.

If the frame mode is selected when writing image data, the memory controller 70 writes image data of even and odd fields in the frame memories 71R, 71G, and 71B. If a field mode is selected, the memory controller 70 writes image data of ones of even and odd fields into the frame memories 71R, 71G, and 71B. After this data write, an interpolation process is performed to write frame image data into the frame memories 71R, 71G, and 71B.

In a monitor mode, the memory controller 70 reads the image data from the frame memories 71R, 71G, and 71B and sends it to the monitor D/A converter 68. In a print mode, the memory controller 70 reads image data one line after another from the frame memories 71R, 71G, and 71B and sends it to a print controller 72.

A monitor system is constituted by the D/A converter 68 and the analog signal processor 69. The D/A converter 68 converts three color image data into analog RGB signals and sends them to the analog signal processor 69 which converts the analog RGB signals into NTSC image signals to display frame images on a TV monitor (e.g., home TV monitor) connected to an output terminal 73.

Figure 11:
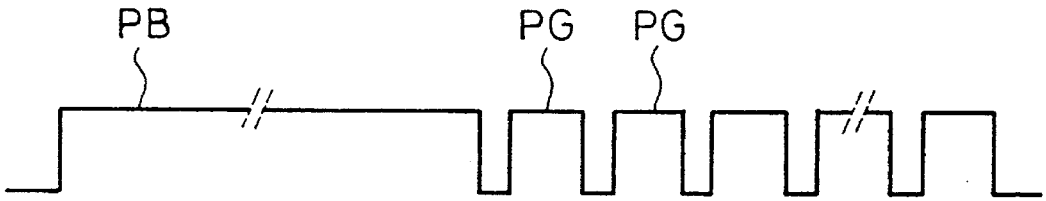
FIG. 11 shows a waveform of a drive pulse supplied to a heating element for recording in one pixel.
Figure 13:
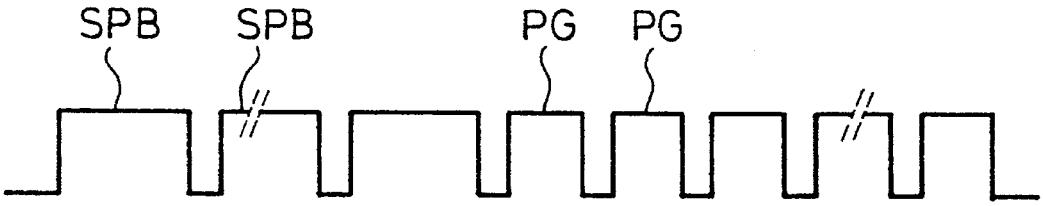
FIG. 13 shows a waveform of a drive pulse for bias heating with a plurality of bias pulses.

A print system is constituted by the print controller 72, a thermal head driver 74, and a thermal head 53. The print controller 72 performs a masking process of three color image data and converts the image data into yellow, magenta, and cyan image data. Of the three color image data, yellow image data for example is retrieved one line after another and sent to the thermal head driver 74. The thermal head driver 74 generates, as shown in FIG. 11, one bias pulse PB for generating bias heat energy and a plurality of image pulses PG for generating image heat energy, respectively for each pixel. As shown in FIG. 13, a plurality of bias pulses SPB may be generated for the bias heat energy for one pixel.

For the preliminary pressed running control, the print controller 72 controls the thermal head driver 74 to apply a bias pulse PB to each heating element once for each line in the preliminary pressed running section. Therefore, at the start of printing after the preliminary pressed running, the thermal head 53, color thermosensitive recording sheet 11, and platen drum 10 maintain a thermal equilibrium state. It is therefore possible to thermally print images at a desired density from the print start position PS of the print area, without degrading grey balance immediately after the start of printing.

Next, the operation of the direct thermal color printer constructed above will be described. As shown in FIG. 6, while feeding a recording sheet, the platen drum 10 is in a halt state with the clamper 13 standing generally vertically at the home position HP. The feed roller pair 27 nips a color thermosensitive recording sheet 11 supplied from a cassette (not shown), and feeds it toward the platen drum 10. The feed roller pair 27 temporarily stops when the leading end portion 11*a* of the color thermosensitive recording sheet 11 enters between the platen drum 10 and the clamper 13. After the clamper 13 clamps the leading end portion 11*a* of the color thermosensitive recording sheet 11, the platen drum 10 and the feed roller pair 11 rotate to wind the color thermosensitive recording sheet 11 about the circumferential wall of the platen drum 10.

The pulse motor 7 stepwise rotates the platen drum 10 by one line using four drive pulses. Since the one step is very small, the platen drum 10 rotates generally at an equal speed. When the count of the drive pulses becomes Pαy, the system controller 52 detects that the thermal head 53 faces the preliminary pressed running start position Py for yellow, and actuates the pressing mechanism 55 to press the heating element array 54 of the thermal head 53 against the platen drum 10. Each heating element is applied with the bias pulse PB for yellow to apply the bias heating energy BY to the color thermosensitive recording sheet 11. After the preliminary pressed running is performed for a predetermined number of lines (e.g., DP-Pαy), the system controller 52 applies each heating element of the thermal head 53 with image pulses PG corresponding to the gradation of image data to supply the image heat energy GYj. In this manner, each pixel on the first line at the print start position PS of the print area PA is applied with the bias heat energy BY and the image heat energy GYj so as to print a yellow dot at a desired density. While the yellow image is printed for each line, the printed pixels are optically fixed by the yellow fixing lamp 22.

As shown in FIG. 8, after the printed yellow image has been optically fixed, the platen drum 10 is rotated at high speed. When the home position sensor 30 detects the home position, the number of drive pulses of the pulse motor 7 starts being counted. When the count becomes Pαm, the preliminary pressed running control is performed in the manner similar to the yellow image. For the preliminary pressed running control, each heating element of the thermal head 53 is pressed against the platen drum 10 by the pressing mechanism 55 and performs preheating using the bias heat energy BM. After the preliminary pressed running is performed by the same number of lines as the yellow image, each heating element prints the magenta image one line after another and the magenta image is optically fixed by the magenta fixing lamp 24. Similarly, the preliminary pressed running control with preheating is performed before actually printing the cyan image, and thereafter, the cyan image is printed one line after another from the print start position PS of the print area PA. After the completion of the three color frame sequential printing, the platen drum 10 and the feed roller pair 27 are rotated in the reverse direction for the time period of T4. With this reverse rotation of the platen drum 10, the trailing edge of the color thermosensitive recording sheet 11 is guided to the feed/discharge path 26 to discharge the recording sheet 11.

Preheating during the preliminary pressed running is effective for preventing shading. The thermal transfer printing method uses the same ink transfer temperature for each color so that there is no color registration shift in the print area. Therefore, in the thermal transfer printing, the same preliminary pressed running start position is used for each color, and preheating is performed for each color at the same heat energy within the range not allowing ink transfer. As described previously, this preheating preferably uses a bias heat energy having a level just before the ink transfer level. As described above, the recording sheet stops at the start of this preliminary pressed running, so that the same area may be heated a plurality of times. In such a case, the heat energy rises and ink transfer occurs. In order to avoid this, at the initial stage of this preliminary pressed running, preheating is preferably performed at about one-half of the bias heat energy.

Figure 12:
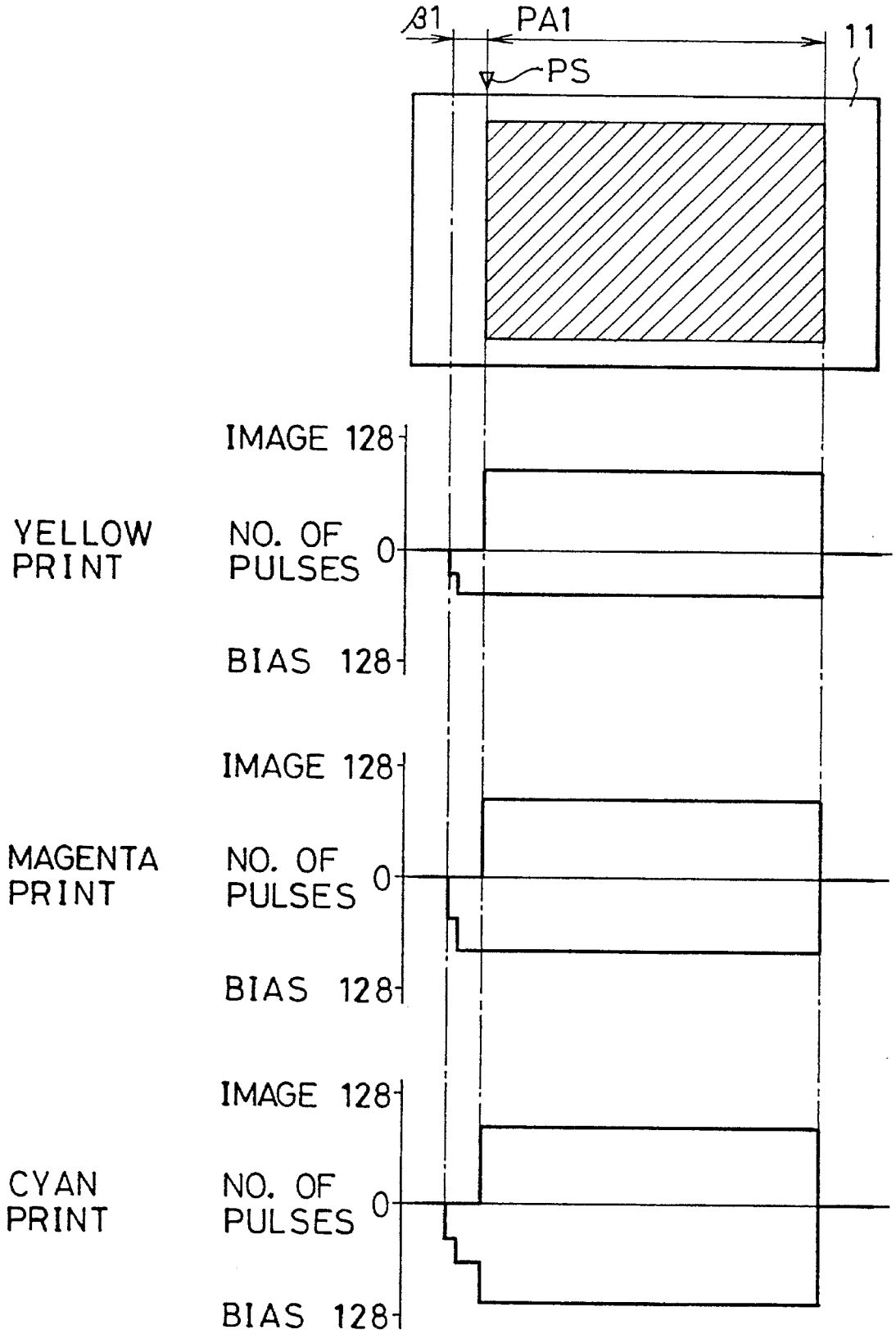
FIG. 12 is a diagram explaining a thermal printing method preventing shading.

In the direct color thermal printing, conspicuous shading is generated when printing a cyan image requiring a high coloring energy. If it is sufficient that only shading is to be avoided and color registration shift is permitted, the same preliminary pressed running start position is used for each color. This provides a merit of a simple print sequence. This embodiment is illustrated in FIG. 12. In this embodiment, 24 lines are set for the preliminary pressed running section β1 relative to the print area PA1 of 704 lines.

In the preliminary pressed running section, preheating using the bias heat energy is performed. In order to avoid coloring immediately after the start of the preliminary pressed running, the bias heat energy is halved during several lines immediately after the start of the preliminary pressed running. In order to halve the bias heat energy, the width of the bias pulse PB is narrowed. If a plurality of sub-bias pulses SBP are used for the bias heating, the number of sub-bias pulses SBP is halved. Alternatively, the voltage applied to the heating element array may be lowered.

In the preliminary pressed running section for cyan, if a large bias heat energy BC is applied, yellow stains are generated by heat and caused by residual materials after the optical fixation of yellow and magenta coloring components. Such Y stains are particularly conspicuous on a white print area where no color is developed. To avoid this, the bias heat energy is set equal to or slightly smaller than the magenta bias heat energy BM during the time period of one or several lines at the initial stage of the preliminary pressed running section.

Figure 14:
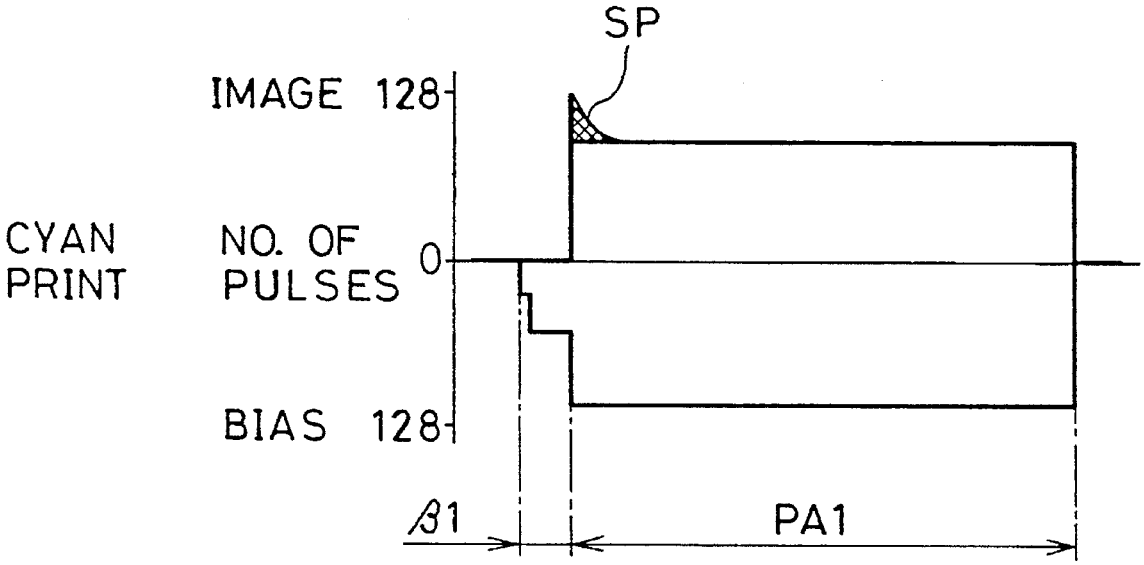
FIG. 14 is a diagram explaining an illustrative embodiment wherein a deficiency of bias heating is supplemented by an image pulse for printing a cyan image.

If a coloring heat energy necessary for a desired coloring density cannot be obtained at the first line in the print area because the cyan bias heat energy has been set small in the cyan preliminary pressed running section, a supplementary pulse SP such as shown in FIG. 14 is added. In this case, one line print cycle is determined while considering a margin for the supplementary pulse SP in addition to the image pulse. In this embodiment, in order to suppress the generation of Y stains, the number of sub-bias pulses for initial several preheating lines is set to about ¼ to ⅓ of the number of sub-bias pulses used for the printing.

In the above embodiments, a recording sheet is wound about a platen drum. The invention is applicable to the case where a plurality of feed roller pairs are disposed in a straight sheet path to reciprocally transport the recording sheet. Furthermore, the invention is also applicable to a serial printer which moves a thermal head in the subsidiary scan direction during printing.

Although the present invention has been described with reference to the preferred embodiments shown in the drawings, the invention should not be limited by the embodiments but, on the contrary, various modifications, changes, combinations and the like of the present invention can be effected without departing from the spirit and scope of the appended claims.

I claim:

1. A direct color thermal printing method for printing a full-color image on a color thermosensitive recording sheet while pressing and heating said color thermosensitive recording sheet with a thermal head, said color thermosensitive recording sheet having at least three thermosensitive coloring layers including a yellow thermosensitive coloring layer, a magenta thermosensitive coloring layer, and a cyan thermosensitive coloring layer, respectively formed on a base, thermal sensitivities of said thermosensitive coloring layers increasing in accordance with an order of said thermosensitive coloring layers toward a top of said color thermosensitive recording sheet, and said thermal head having a plurality of heating elements disposed in line in a main scan direction, the direct color thermal printing method comprising the steps of:

providing a relative motion between said thermal head and said color thermosensitive recording sheet in a subsidiary scan direction perpendicular to said main scan direction;

selectively heating each of said plurality of heating elements from a print start position to a print end position in said subsidiary scan direction in association with said relative motion to color said thermosensitive coloring layers downwardly from the top of the color thermosensitive recording sheet toward said base in frame-sequential fashion; and changing said print start positions of said thermosensitive color layers in accordance with an expansion/contraction of said color thermosensitive recording sheet caused by heating of said plurality of heating elements, so that centers of print areas of the three colors coincide with each other.

2. The direct color thermal printing method according to claim 1, wherein said yellow thermosensitive color layer is an uppermost layer of said color thermosensitive recording sheet and said cyan thermosensitive coloring layer is a lowermost layer.

3. The direct color thermal printing method according to claim 2, wherein said yellow thermosensitive coloring layer is optically fixed by ultraviolet radiation in a first wavelength range, immediately after printing, and said magenta thermosensitive coloring layer is optically fixed by ultraviolet radiation in a second wavelength range, immediately after printing.

4. The direct color thermal printing method according to claim 1, wherein said color thermosensitive recording sheet is wound on a periphery of a rotatable platen drum, and said thermal head extends in an axial direction of said platen drum.

5. The direct color thermal printing method according to claim 4, wherein one line is printed on said color thermosensitive recording sheet after said platen drum is intermittently fed by a predetermined distance.

6. The direct color thermal printing method according to claim 2, wherein said print start position of said yellow thermosensitive coloring layer is farthest from a leading edge of said color thermosensitive recording sheet, and said print start position of said cyan thermosensitive coloring layer is nearest to the leading edge of said color thermosensitive recording sheet.

7. A direct color thermal printing method for use with a color thermosensitive recording sheet having first through third thermosensitive coloring layers of respective first through third colors arranged in order from a surface to a base of the color thermosensitive recording sheet, comprising the steps of:

determining an expansion/contraction characteristic of the color thermosensitive recording sheet;

determining print start positions for each of the first through third thermosensitive coloring layers based on the determined expansion/contraction characteristic; and heating the color thermosensitive recording sheet to print a full color image in a subsidiary scan direction from the determined print start positions of each of the first through third thermosensitive coloring layers in a frame sequential manner so that centers of respective print areas of the first through third colors coincide with each other.

8. The direct color thermal printing method of claim 7, wherein the first through third thermosensitive coloring layers have respective first through third thermal sensitivities, the first thermal sensitivity being greater than the second thermal sensitivity and the second thermal sensitivity being greater than the third thermal sensitivity.

9. The direct color thermal printing method of claim 8, wherein the first through third colors are respectively yellow, magenta and cyan.

10. The direct color thermal printing method of claim 8, wherein the print start position of the first thermosensitive coloring layer is farther from a leading edge of the color thermosensitive recording sheet than the print start positions of the second and third thermosensitive coloring layers and the print start position of the third thermosensitive coloring layer is nearer to the leading edge of the color thermosensitive recording sheet than the print start positions of the first and second thermosensitive coloring layers.

11. The direct color thermal printing method of claim 7, wherein said step of heating comprises pressing a thermal head having a plurality of heating elements arranged in a main scan direction against the color thermosensitive recording sheet.

12. The direct color thermal printing method of claim 11, wherein said step of heating further comprises providing relative motion between the color thermosensitive recording sheet and the thermal head in the subsidiary scan direction which is perpendicular to the main scan direction.

13. A direct color thermal printer for use with a color thermosensitive recording sheet having first through third thermosensitive coloring layers of first through third colors arranged in order from a surface to a base of the color thermosensitive recording sheet, comprising:

a printing head having a plurality of heating elements arranged in a main scan direction;

driving means for providing relative movement between the color thermosensitive recording sheet and said printing head in a subsidiary scan direction which is perpendicular to the main scan direction; and control means, coupled to said printing head and said driving means, for determining print start positions for each of the first through third thermosensitive coloring layers in accordance with an expansion/contraction characteristic of the color thermosensitive recording sheet and controlling said printing head and said driving means to heat the color thermosensitive recording sheet to print a full color image in the subsidiary scan direction from the determined print start positions of each of the first through third thermosensitive coloring layers in a frame sequential manner so that centers of respective print areas of the first through third colors coincide with each other.

14. The direct color thermal printer of claim 13, wherein the first through third thermosensitive coloring layers have respective first through third thermal sensitivities, the first thermal sensitivity being greater than the second thermal sensitivity and the second thermal sensitivity being greater than the third thermal sensitivity.

15. The direct color thermal printer of claim 14, wherein the first through third colors are respectively yellow, magenta and cyan.

16. The direct color thermal printer of claim 15, wherein the print start position of the first thermosensitive coloring layer is farther from a leading edge of the color thermosensitive recording sheet than the print start positions of the second and third thermosensitive coloring layers and the print start position of the third thermosensitive coloring layer is nearer to the leading edge of the color thermosensitive recording sheet than the print start positions of the first and second thermosensitive coloring layers.

17. The direct color thermal printer of claim 13, further comprising a rotatable platen drum, the color thermosensitive recording sheet being wound on a periphery of said rotatable platen drum and said printing head extending in an axial direction of said rotatable platen drum parallel to the main scan direction.

18. The direct color thermal printer of claim 17, wherein said control means controls said printing head and said driving means to print one line on the color thermosensitive recording sheet after said rotatable platen drum is intermittently fed by a predetermined distance.

19. The direct color thermal printer of claim 13, further comprising:

a first lamp for radiating ultraviolet light in a first wavelength range to optically fix the first thermosensitive coloring layer immediately after printing of the first color; and a second lamp for radiating ultraviolet light in a second wavelength range to optically fix the second thermosensitive coloring layer immediately after printing of the second color.

20. The direct color thermal printer of claim 19, wherein the first through third colors are respectively yellow, magenta and cyan.

* * * * *